United States Patent [19]

Joseph

[11] 4,162,081

[45] Jul. 24, 1979

[54] SAFETY RELEASE HAND LOOP FOR SKI POLE

[76] Inventor: Claude Joseph, 60 Avenue de Geneve, Sallanches, (Haute Savoie), France

[21] Appl. No.: 876,210

[22] Filed: Feb. 9, 1978

[30] Foreign Application Priority Data

Feb. 10, 1977 [FR] France ..... 77 04302

[51] Int. Cl.[2] ..... A63C 11/22

[52] U.S. Cl. ..... 280/11.37 H; 24/77 S

[58] Field of Search ..... 280/11.37 H, 11.37 D, 280/11.37 B; 24/77 S, 77 R, 68 SK, 69 SK, 70 SK

[56] References Cited

U.S. PATENT DOCUMENTS

| | | | |
|---|---|---|---|
| 3,163,436 | 12/1964 | Shride et al. | 280/11.37 H |
| 3,251,109 | 5/1966 | Wilson et al. | 24/77 S |
| 3,295,178 | 1/1967 | Smith | 24/77 R |
| 3,995,872 | 12/1976 | Joseph | 280/11.37 H |

FOREIGN PATENT DOCUMENTS

| | | | |
|---|---|---|---|
| 2206740 | 7/1973 | Fed. Rep. of Germany | 280/11.37 H |
| 2313095 | 12/1976 | France | 280/11.37 H |
| 380615 | 9/1964 | Switzerland | 280/11.37 H |

*Primary Examiner*—David M. Mitchell
*Attorney, Agent, or Firm*—Karl F. Ross

[57] ABSTRACT

A ski pole has at its handle end a loop formed by a pair of straps each having one end secured to the ski pole and another free end. One of these free ends passes through a buckle having a holding formation which may be snapped into an elastically deformable seat fixed to the free end of the other strap. The one strap can be slid through the buckle to adjust the size of the loop. In case of emergency a sharp pull exerted between the straps will pull the buckle out of the clip and free the user's hand.

9 Claims, 3 Drawing Figures

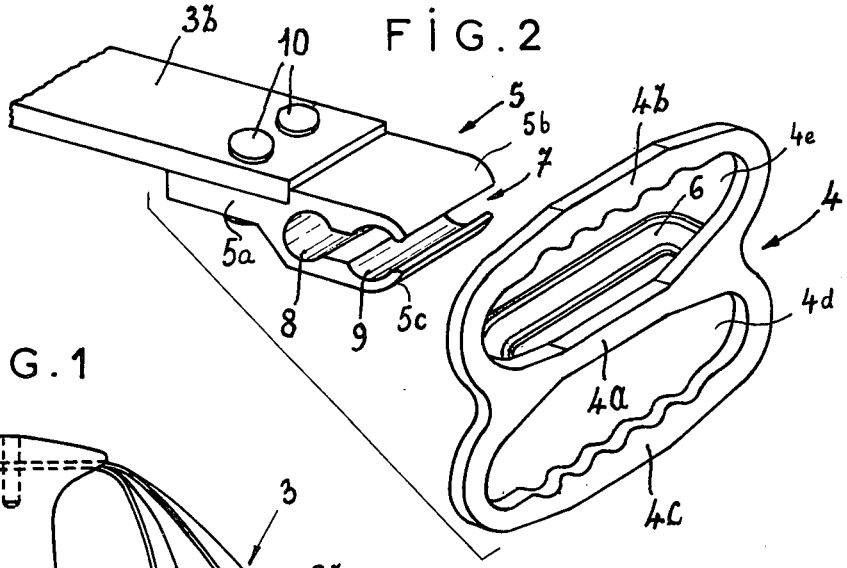
FIG. 2
FIG. 1
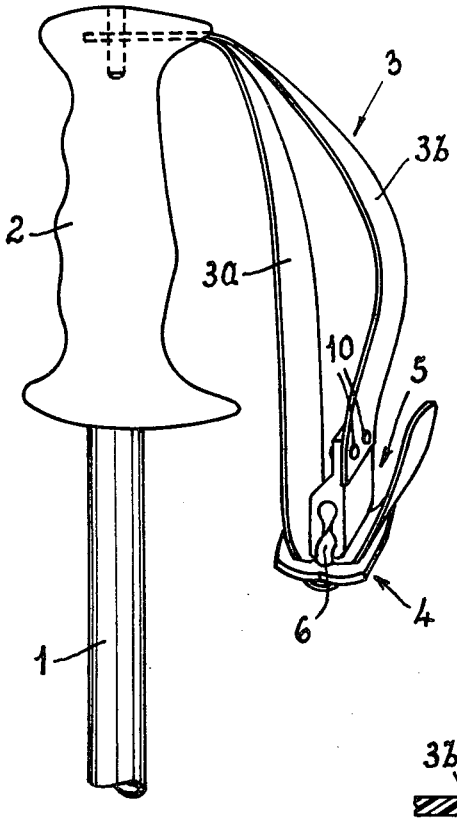
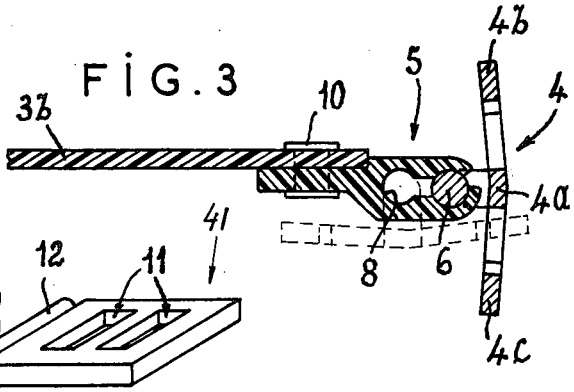
FIG. 3
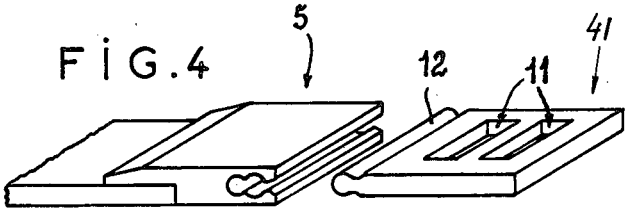
FIG. 4

SAFETY RELEASE HAND LOOP FOR SKI POLE

FIELD OF THE INVENTION

The present invention relates to a ski pole. More particularly this invention concerns a hand loop which is engaged around the wrist of the user of a ski pole to prevent accidental dropping of the pole.

BACKGROUND OF THE INVENTION

A ski pole has at its upper or handle end a loop which is normally engaged around the wrist of the user of the ski pole so that the pole will not be lost if accidentally or intentionally released by the hand of the skier. This safety loop has, however, the considerable disadvantage that if the pole accidentally becomes lodged or wedged in an obstacle the skier's arm which is engaged through the loop can be seriously injured. Thus if for instance the ski pole catches on a branch or the like as the skier moves downhill, it is entirely possible for the skier to be yanked over backwards and have his or her arm broken.

It has been suggested to overcome this by providing an openable hand loop. In the simplest such system the loop is formed by two separate straps each having a free end and an opposite end secured to the pole. The free ends are releasably secured together by a snap or the like so that when the loop is stressed beyond a certain point the snap will open and release the encircled hand.

The considerable disadvantage of such an arrangement is that it is very difficult to make it adjustable for different sizes. Thus a skier with a particularly large or small wrist, or who wears particularly bulky ski clothes, cannot personally size the loop.

OBJECTS OF THE INVENTION

It is therefore an object of the present invention to provide an improved hand loop for a ski pole.

It is another object to provide such a loop which not only is of the above-described opening safety type, but which also allows complete adjustment of the size of the hand loop.

SUMMARY OF THE INVENTION

These objects are attained according to the present invention in a safety-type hand loop of the above-described general type, but wherein a buckle which is engageable with the free end of one of the straps for adjustment of the loop has a formation which is releasably seated within a recess of a clip on the free end of the other strap. Thus the loop has the appearance and operates in the same manner as a typical hand loop, that is by sliding the one strap through the buckle so that it is possible to adjust the hand loop without difficulty. Nonetheless when stressed beyond a certain point the formation of the buckle will pull out of the clip and open up the loop, leaving the clip on the free end of one of the straps and the buckle on the free end of the other strap.

According to another feature of this invention the clip is formed of a single block of elastically deformable synthetic resin. It has a pair of arms or portions forming an outwardly open U that constitutes the recess in which the holding formation of the buckle is received. These arms or portions may each have an inwardly open elongated groove so that two seats are formed for the holding formation of the buckle.

The buckle according to this invention has a pair of throughgoing holes through which the free end of the one strap is threaded in standard buckle fashion, so that the free end can be pulled through to the extent desired to establish the appropriate loop size. The back of this generally planar buckle may be provided with a U-shaped wire or rod whose legs are connected to the flat buckle and which forms the holding formation. It is also within the scope of this invention to form a single flat buckle having at one edge at least one outwardly extending ridge that constitutes the holding formation. In this case the buckle may be made integrally of a single flat piece of synthetic-resin material.

With the system according to the present invention the user can not only set the loop to virtually any desired size in the normal manner for a good ski pole, but also can be sure that in case of an accident the loop will simply pull off his or her hand and open up. After such releasing it is a relatively simple matter to snap the formation on the buckle back into the clip to restore the loop to perfectly usable condition.

BRIEF DESCRIPTION OF THE DRAWING

FIG. 1 is a side view of the handle end of a ski pole equipped with a loop according to this invention;

FIG. 2 is a perspective view of the principal structure of the loop in accordance with this invention;

FIG. 3 is a longitudinal section through the structure of FIG. 2 in assembled condition; and FIG. 4 is a perspective view showing another arrangement in accordance with this invention.

SPECIFIC DESCRIPTION

As shown in FIG. 1 a ski pole 1 according to this invention has at its upper end a handle 2 to which is secured a loop 3 constituted by a pair of straps 3*a* and 3*b* each secured at one end to the handle 2 and pole 1. The one strap 3*a* passes through two holes 4*d* and 4*e* of a buckle 4, passing over the central web 4*a* of the buckle and under the two ridged outer portions 4*b* and 4*c* thereof. When the strap 3*a* is pulled tightly through the buckle 4 it is locked longitudinally in place and will not slide thereon.

The other strap carries as shown in FIG. 2 a clip 5 having a rear portion 5*a* secured by rivets 10 to the free end of the strap 3*b* and a pair of legs 5*b* and 5*c* together defining a recess 7 in which are formed two generally cylindrical seats 8 and 9. A U-shaped holding formation 6 constituted as a piece of metallic wire secured to the metallic buckle 4 is of substantially the same diameter as the seats 8 and 9 and can be engaged in recess 7 so as to be elastically held between the legs 5*b* and 5*c*. When engaged in the outermost seat 9 the buckle 4 can pivot about the holding formation 6, but when the formation 6 is engaged in the rear seat 8 the buckle 4 must lie flatly to one side or the other of the clip 5 as shown in dot-dash lines in FIG. 3.

It is also possible as shown in FIG. 4 to form a buckle 4' entirely of synthetic-resin material and basically as a flat plate having two rectangular holes 11 through which the end of the strap 3*a* may pass. In addition at its one edge the buckle 4' is formed with a pair of oppositely outwardly directed ridges 12 that give the edge the shape of a generally cylindrical bead which can fit in the outermost seat 9. Such an arrangement can be produced at relatively low cost and in use constitutes a very flat comfortable assembly.

I claim:

1. In combination with a ski pole, a hand loop comprising:

a pair of flexible straps each having a free end and an opposite end secured to said pole;

a buckle formed with a pair of openings through which one of said free ends extends and having a projecting holding formation, said buckle being slidable and positionable along said strap having said one free end for adjustment of said loop; and a clip on the other of said free ends having an elastically deflectable portion defining a recess in which said formation is snugly engageable, whereby on pulling-apart of said free ends said formation of said buckle can elastically deform said portion and pull out of said recess.

2. The combination defined in claim 1 wherein said clip is fixed to said other free end and has a pair of such portions each formed as an elastically bendable leg, said legs together defining said recess.

3. The combination defined in claim 2 wherein said clip is unitarily formed with said legs of a synthetic resin.

4. The combination defined in claim 2 wherein said buckle is generally planar.

5. The combination defined in claim 4 wherein said formation is a U-shaped rigid element having legs secured to said buckle.

6. The combination defined in claim 5 wherein said buckle and formation are of metal.

7. The combination defined in claim 4 wherein said formation lies generally in the plane of said buckle and is constituted by at least one ridge.

8. The combination defined in claim 7 wherein said buckle and formation are of a synthetic resin.

9. The combination defined in claim 2 wherein said legs are each formed with at least one ridge opened toward the other leg and together forming a seat for said formation.

* * * * *